United States Patent [19]

Heinemann

[11] 4,218,974

[45] Aug. 26, 1980

[54] SCATTERABLE ANTIPERSONNEL MINE

[75] Inventor: Robert W. Heinemann, Dover, N.J.

[73] Assignee: The United States of America as represented by the Secretary of the Army, Washington, D.C.

[21] Appl. No.: 618,269

[22] Filed: Feb. 16, 1967

[51] Int. Cl.[3] ..... F42B 23/10

[52] U.S. Cl. ..... 102/8

[58] Field of Search ..... 149/2, 35; 102/8, 70, 102/20, 22, 23

[56] References Cited

U.S. PATENT DOCUMENTS

| | | | |
|---|---|---|---|
| 2,146,033 | 2/1939 | Seavey et al. | 149/35 X |
| 2,368,310 | 1/1945 | Lecky et al. | 102/70 |
| 3,046,888 | 7/1962 | Gordon | 102/22 |

*Primary Examiner*—Charles T. Jordan

*Attorney, Agent, or Firm*—Nathan Edelberg; Robert P. Gibson; A. Victor Erkkila

[57] ABSTRACT

An antipersonnel mine having a pressure sensitive explosive diluted and desensitized by an inert bulking agent and a volatile liquid to temporarily unarm the explosive until the volatile liquid is evaporated. A method for desensitizing the mine by addition of the volatile liquid before the explosive sensitizer is added.

4 Claims, 2 Drawing Figures

SCATTERABLE ANTIPERSONNEL MINE

Figure 1:
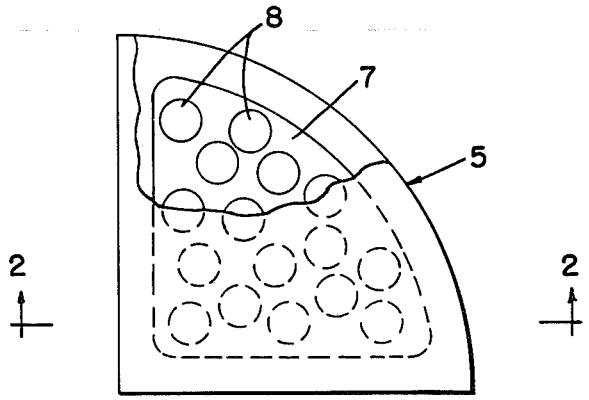

This invention relates to an antipersonnel mine, and particularly, to a mine containing a pressure sensitive explosive which may be desensitized for a limited time to facilitate safe packing and shipping and which is capable of being scattered from a moving vehicle without detonating.

The need for a low cost scatterable antipersonnel mine capable of delayed arming and yet capable of being safely manufactured, transported and used has been a formidable challenge to the munition designer. One way of solving the problem was to employ fuze mechanisms adapted to this purpose. This method has been found generally to involve costly and complex fuzing problems.

Another possible and available approach to the solution of this problem was to use a single explosive material, and then attempt to disarm it for a limited time. This was completely unsatisfactory for this application because the explosive material available, such as cyanuric triazide, proved to be extremely complex to manufacture and too sensitive and toxic to use. Furthermore these explosives would generally sublime and selfdetonate during manufacture and storage.

In general, the inventive apparatus comprises an improved antipersonnel mine which has overcome the disadvantages of the prior art and has resulted in a low cost, easily handled explosive device which is higly effective as a mine barrier system.

The inventive apparatus comprises a body of sensitized initiating explosive material which will detonate when external pressure is exerted upon it. To facilitate handling and shipping of the mine and to enable the mine to be scattered over an area without detonation occuring, a quantity of inert material wetted with a volatile liquid is added to and mixed with the initiating explosive. The wet material dilutes and temporarily desensitizes the explosive concentration by separating the explosive crystals from each other. Rearming of the mine occurs when the volatile liquid is evaporated and the initiating explosive is again sensitized for detonation. Thus, a delayed arming time is obtained.

The entire mixture is housed in a porous cloth bag to facilitate the evaporation of the volatile liquid therethrough when the mine is exposed to the air. A flat rigid back-up plate is inserted in the housing in contact with the explosive mixture to provide equal amounts of the mixture on either side of the plate. The plate provides resistance for the explosive mixture when external pressure is applied to the housing following the rearming delay, and thereby a larger amount of energy is exerted on the explosive being crushed.

The back-up plate is provided with a plurality of spaced apertures through its surfaces. Since the explosive mixture is positioned on either side of a flat plate, and the mine is scattered randomly on the ground in operation, the explosive mixture would tend to arm on top of the back-up plate, but would remain unarmed for a longer time period underneath the plate; that is the arming of the explosive mixture on the side of the mine lying on the ground would be retarded. Therefore, the apertures provided in the plate permit the necessary evaporation of the volatile liquid required from the explosive mixture below the plate to maintain equal sensitivity throughout the mine.

Figure 2:
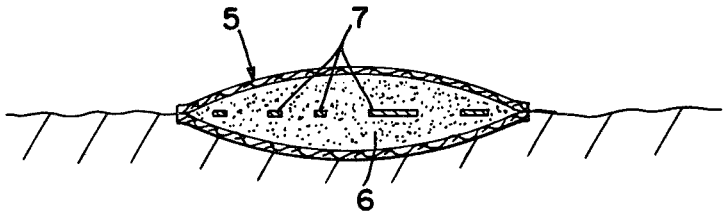

In the drawing,

FIG. 1 is a top view partially in section, of an antipersonnel mine embodying the invention, and FIG. 2 is a side view, in cross section, of the mine of FIG. 1, taken on the section line 2—2 thereof, as it appears in operation and showing further details of construction in accordance with the invention.

The invention may be more fully understood by recourse to the drawing, wherein like reference numerals apply to like parts throughout. Referring now to FIGS. 1 and 2 of the drawing, there is shown a mine housing 5 constructed of a porous material. The housing is preferably a woven poplin fabric of dacron and cotton fibers but is not limited to this particular material. A sateen fabric, or a microporous polyethylene material may also be used with similar results. The housing 5, or cloth bag, is cut in the desired shape and seamed around its edges (not shown) after the contents of the mine have been inserted within the boundary of the edges. These include an explosive charge or body 6 of an explosive chemical mixture and a perforated flat rigid or semi rigid stiffener or back-up plate 7.

The explosive mixture 6 is placed within the housing on either side of the stiffener or back-up plate 7. The stiffener plate provides the necessary resistance against which the explosive mixture may be ground upon in response to external pressure exerted on the housing 5. By way of example, the stiffener plate may be constructed from a 90° vulcanized fiber sheet or fireboard separator of the type manufactured by the Spaulding Fibre Company. An aluminum or plexiglass sheet may also be used.

The explosive mixture 6 comprises a primary explosive sensitized with granulated glass to obtain a body of pressure sensitive material. To this material a bulking agent and a desensitizer liquid are added to temporarily desensitize and disarm the mine for operation. A high explosive base charge or secondary explosive may also be added to the mixture to augment the shattering or crushing effect of the explosive mixture. The sensitized material can then act as the initiating element for the explosive train terminating with the additional high explosive base charge.

The initiating explosive element can be a mixture of lead azide (RD 1333) sensitized with ground pyrex glass of a mixed mesh size, such as 18/32. Other primary explosives can be readily used in place of lead azide and also other abrasive sensitizers, such as sand or carborundum, may be used in place of glass.

The high explosive base charge may comprise cyclonite (RDX), but this is only one example of several other high explosives that can readily be used instead.

The bulking agent is a low density inert material or a diatomaceous-type earth (calcium silicate), such as Cab-O-Sil, manufactured by Godfrey L. Cabot, Inc.

The entire mixture is wet with a volatile desensitizing liquid which, in conjunction with the bulking agent, dilutes and separates the explosive crystals from each other, thereby as above explained, to temporarily desensitize the mine and provide an unarmed pressure sensitive explosive. The liquid may be a fluorinated or chlorinated hydrocarbon, such as chlorothane (1,1,1 trichloroethane), but other desensitizer liquids, such as ethers and alcohols are useable.

The mine becomes sensitized and thereby armed when the volatile liquid is evaporated from the explosive mixture. Therefor, arming of the mine is a function of the vaporization of the liquid used. By adjusting the amount of bulking agent employed, and by proper selection of the desensitizing liquid, a wide range of delayed arming times may be obtained.

The housing 5, as mentioned before, is made of a porous material in order to permit the volatile desensitizer to escape and arm the mine. Upon exposure to the air, the liquid evaporates and the mine becomes armed for detonation in response to pressure of the type exerted by the weight of a human body in stepping on said housing.

In operation, the unarmed mines may be scattered over a large area for use as a personnel mine barrier. The terrain to be protected may consist of sand or soft earth, and thereby present an arming problem. The mine would normally land with the stiffener plate lying parallel to the ground, thereby exposing one portion of the explosive mixture to the air, while the other portion would be lying on and surrounded by the material of the soft terrain as in FIG. 2. That is, the explosive mixture above the stiffener plate would tend to arm much faster than the identical explosive mixture below the plate, due to the retarded evaporation of the desensitizer liquid contained below the plate.

To overcome this problem the stiffener plate 7 is provided with a plurality of spaced apertures 8 through the surface of the plate. The apertures permit the necessary evaporation required from the explosive below the plate, or rather the apertures provide for evaporation from either side through the plate, thereby to eliminate any necessity for the mine to be positioned in a predetermined manner with respect to the ground and to maintain the sensitivity of the mine.

To insure safe handling and storage of the unarmed mines before they are to be employed in operation, the mines are packed in leak-proof, hermetically sealed containers. The shape of the mine was chosen to be quarter-circular, or pie-shaped to facilitate easier and safer packing of the unarmed mine. It is to be understood that the mine is not limited to this particular shape, but may take any desired form and still be effective. The present preferred embodiment though, improved storageability in that a large number of mines may be packed in a tear strip cylindrical metallic can with great ease. As an example, cans containing 8 layers of 4 mines each have been exposed to extreme environmental testing and none have produced any leaks, whereby the mines remained desensitized and unarmed. To insure desensitization, the mines are packed in a bulking-agent desensitizer liquid gel before the top of the container is sealed.

To insure safe loading of the mine, the lead azide is consistently maintained in the wet stage by a water/alcohol mixture. The water/alcohol mixture in the lead azide may be replaced through a washing with absolute alcohol, followed by the organic desensitizer liquid. Mixing of the lead azide, bulking agent, high explosive and desensitizer liquid are conducted together. Loading may be conducted manually by a spooning technique with the glass added separately to the mine. The concentration of desensitizer is maintained at a level, which is in equilibrium with liquid desensitizer just touching the mine. The bulking-agent was wet in an identical fashion until the amount of liquid absorbed was in equilibrium with the liquid reservoir which it touched. When this gel is used in firmly packing the mines, there is a minimum amount of liquid transfer which takes place as a result of dialysis between the liquid in the mines and in the gel, and therefor, the liquid concentration of the mine remains stable until placed in operation. The gel further acts as a reservoir of desensitizer and provides additional safety should the containers inadvertently leak.

While the invention has been shown and disclosed with reference to an antipersonnel mine which may be remotely scattered or merely thrown on the ground for example, it is obvious that it may be applied to a missile or other aerial dispersal systems which would allow the mines to be ejected in flight and thereby cover very large or small and well defined areas.

The significant aspects of the mine of the present invention involve the mixing of the primary explosive material with an abrasive sensitizer, a low density bulking agent and a volatile desensitizer liquid to obtain an unarmed pressure sensitive explosive. A high explosive may also be added to augment the shattering or crushing effect of the mixture. The mixture, when loaded into a porous housing and surrounding a stiffener plate with apertures in it, arms upon exposure to the air and evaporation of the volatile desensitizer liquid.

There is claimed:

1. A scatterable antipersonnel mine capable of arming within a specified delay time comprising, an explosive mixture comprising a high explosive base charge mixed with a sensitized initiating material and a bulking agent wetted with a volatile liquid adapted to dilute and temporarily desensitize said initiating material, and thereby prevent the immediate operation of said mine, said bulking agent providing for a larger quantity of the desensitizer liquid to be in contact with the explosive mixture, a porous outer housing of woven cloth covering said explosive mixture whereby said volatile desensitizer liquid may evaporate there through and thereby resensitize and rearm said material and said mine, and a flat stiffener plate positioned within said housing with said explosive mixture in contact therewith on either side thereof to provide resistance against which said mixture may be ground upon in response to external pressure exerted on said mine, thereby to effect detonation following said resensitizing and rearming delay.

2. A scatterable antipersonnel mine as defined in claim 1, wherein said explosive mixture is placed within said housing on either side of said stiffener plate;

and wherein said stiffener plate is provided with a plurality of apertures therethrough which permit evaporation of said volatile desensitizer liquid from said explosive mixture from either side through said plate.

3. A scatterable antipersonnel mine comprising, a porous pliable woven cloth bag providing a flexible outer housing therefor, a body of explosive material contained in said housing capable of detonating in response to pressure of the type exerted by the weight of a human body in stepping on said housing, a volatile desensitizing agent included within said explosive material to delay the propagation of detonation in said material during the period required to evaporate said agent therefrom, whereby said mine is armed after a predetermined delay, and a flat stiffener plate mounted in and extending transversely through said housing and the body of explosive material to provide substantially equal amounts of said explosive material on either side thereof and to provide resistance to movement of said explosive material in response to said pressure being exerted on said housing, thereby to effect detonation of said explosive material and firing of said mine, said stiffener plate being provided with a plurality of substantially uniformly spaced apertures therethrough, whereby a portion of said desensitizing agent which may in use be positioned below said plate may more easily be evaporated.

4. A scatterable antipersonnel mine as defined in claim 3, wherein said body of explosive material includes a sensitized initiating mixture as a primary explosive and a high explosive base charge as a secondary explosive, and wherein said desensitizing agent includes a bulking agent wetted with a volatile liquid.

* * * * *